United States Patent [19]

Kesteloot

[11] Patent Number: 4,714,060

[45] Date of Patent: Dec. 22, 1987

[54] COMPOSITE ENGINE

[75] Inventor: Raymond P. Kesteloot, Lake Havasu, Ariz.

[73] Assignee: R K W Industries, Inc., Balboa Island, Calif.

[21] Appl. No.: 825,859

[22] Filed: Feb. 4, 1986

[51] Int. Cl.[4] ..... F02F 7/00

[52] U.S. Cl. ..... 123/195 R; 123/DIG. 8; 74/598

[58] Field of Search ..... 123/195 R, DIG. 6, DIG. 7, 123/DIG. 8; 74/597, 598

[56] References Cited

U.S. PATENT DOCUMENTS

| | | | |
|---|---|---|---|
| 26,222 | 6/1967 | Fielder | 123/197 AC |
| 934,675 | 9/1909 | Landgraf | 92/59 |
| 2,218,332 | 4/1939 | Fowler | 74/44 |
| 2,339,985 | 1/1944 | Engler | 123/56 BC |
| 2,491,630 | 12/1949 | Voorhies | 123/DIG. 6 |
| 2,575,859 | 11/1951 | Bergman | 123/195 R |
| 2,618,253 | 11/1952 | Angle | 123/DIG. 6 |
| 2,730,912 | 1/1956 | Marinelli | 74/597 |
| 3,561,416 | 2/1971 | Kiekhaefer | 123/195 R |
| 3,608,396 | 9/1971 | Bentley | 74/598 |
| 4,046,028 | 9/1977 | Vachris | 74/597 |
| 4,622,864 | 11/1986 | Fetouh | 123/197 AC |

FOREIGN PATENT DOCUMENTS

| | | | |
|---|---|---|---|
| 1002565 | 2/1957 | Fed. Rep. of Germany . | |
| 747742 | 4/1956 | United Kingdom | 74/597 |
| 789342 | 1/1958 | United Kingdom . | |
| 851616 | 10/1960 | United Kingdom . | |

*Primary Examiner*—Craig R. Feinberg
*Assistant Examiner*—David A. Okonsky
*Attorney, Agent, or Firm*—Lyon & Lyon

[57] ABSTRACT

A two cycle engine having multiple cylinders which is capable of expanding from two or four or more cylinders. A composite crankshaft is built up by combining components including crank webs, bearing shafts and crank pins. A composite crankcase also may expand to accommodate the number of cylinders required through the use of common mating surfaces. The mating surfaces provide opposed thrust surfaces for each pair of crank pins.

11 Claims, 13 Drawing Figures

COMPOSITE ENGINE

BACKGROUND OF THE INVENTION

The field of the present invention is engines and particularly small, lightweight engines.

Small, lightweight engines have found recent utility in such applications as remotely piloted vehicles, ultralight aircraft and the like. In such uses, the forward extension of the engine is often possible to convert a composite engine from two to four and even to six cylinders. The number of cylinders would specifically depend upon the load and power required.

Engines have been developed which are capable of being expanded from one or two cylinders to a greater number of cylinders through coupling of crankcases end to end. In doing so, often replacement crankshafts are required to accommodate the increased number of crank pins. Additionally, bearings are often incorporated into each end of each crankcase component. Such designs are truly nothing more than hooking multiple engines together. Naturally, this can create excessively lengthy engines and necessarily increase the weight of both the engines in general and the crankshaft in particular. Consequently, the utility of such devices can be diminished.

SUMMARY OF THE INVENTION

The present invention is directed to a composite engine structure which is simple in design, lightweight and easily convertible from two to four or more cylinders or back again.

In a first aspect of the present invention, the crankshaft is of a composite design including an intermediate crank web to which crank pins are fixed in diametrically opposed positions. A first bearing shaft and second bearing shaft forming the ends of the crankshaft also include crank webs capable of mating with the crank pins of the intermediate bearing web. A crankshaft extension is provided which would include a second intermediate bearing web and an additional bearing shaft with two additional crank webs. In this way, a crankshaft for a two cylinder engine may be converted into a four cylinder engine. With additional crankshaft extensions, additional cylinders may be accommodated. The crank webs may be coupled with the crank pins by means of a locking taper fit therebetween.

In a second aspect of the present invention, a composite engine incorporates a crankcase which includes a main crankcase, an intermediate crankcase and a crankcase hub. The main crankcase and crankcase hub would be employed for a two cylinder engine while the intermediate crankcase may be added between the main crankcase and the crankcase hub to create a four cylinder engine. Additional intermediate crankcases may be added to add additional cylinders.

Accordingly, it is an object of the present invention to provide an improved composite engine. Other and further objects and advantages will appear hereinafter.

DETAILED DESCRIPTION OF THE PREFERRED EMBODIMENT

Figure 1:
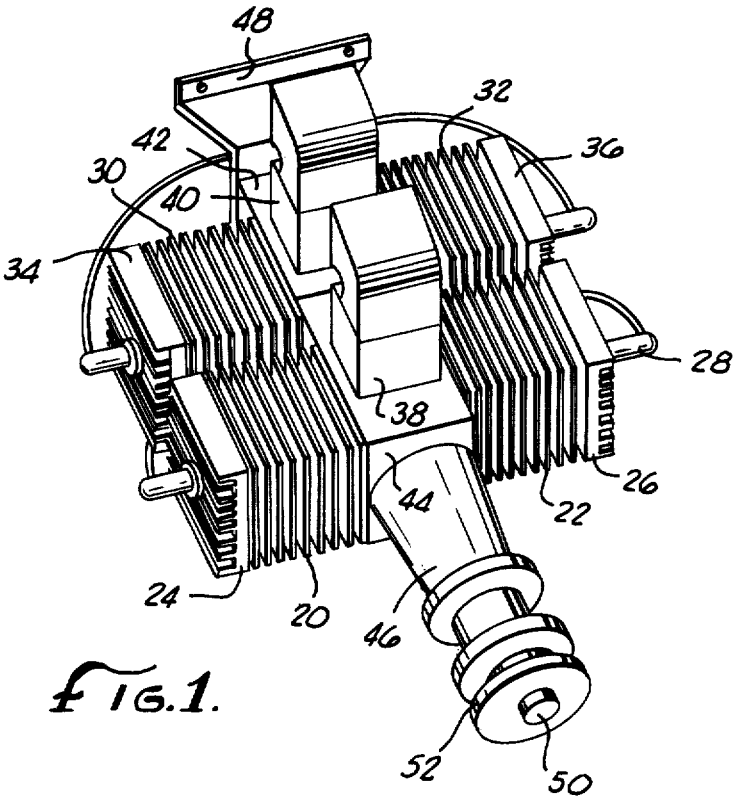
FIG. 1 is an oblique view of a four cylinder composite engine of the present invention.
Figure 2:
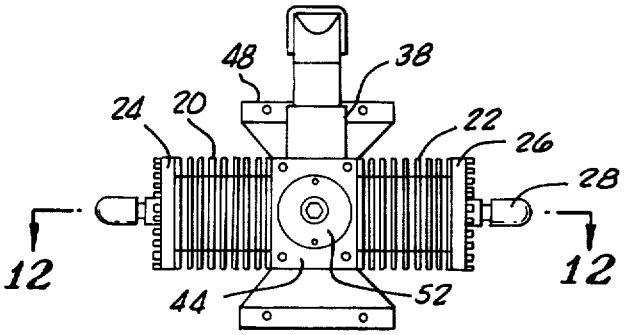
FIG. 2 is an end view of the engine of FIG. 1.
Figure 3:
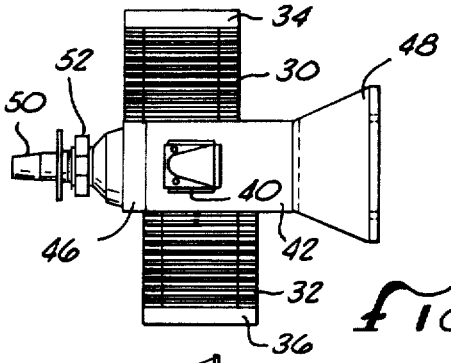
FIG. 3 is a plan view of a two cylinder composite engine of the present invention.
Figure 4:
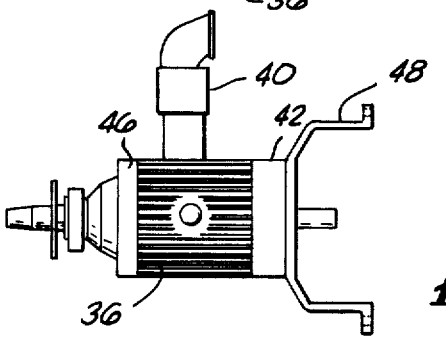
FIG. 4 is a side view of the engine of FIG. 3.
Figure 5:
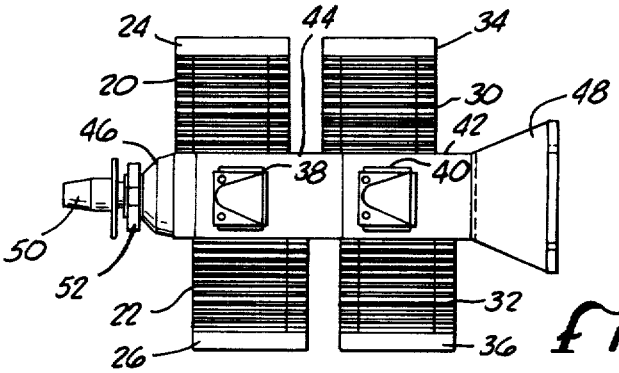
FIG. 5 is a plan view of a four cylinder composite engine of the present invention.
Figure 6:
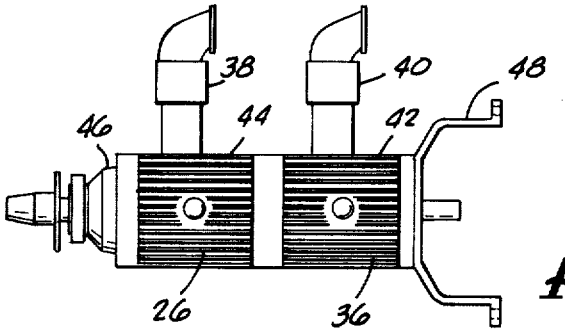
FIG. 6 is a side view of the engine of FIG. 5.

Turning in detail to the drawings, a composite engine is illustrated in both two and four cylinder configurations. FIG. 1 illustrates the engine in its four cylinder configuration including forward cylinders 20 and 22 having cylinder heads 24 and 26, respectively. Sparkplug ignition systems 28 are also illustrated. The engine also includes rearward cylinders 30 and 32 also having cylinder heads 34 and 36, respectively. Carburetors 38 and 40 are illustrated as being mounted on the crankcase of the engine. The engine of FIGS. 1 and 2 is also illustrated in FIGS. 5 and 6 while a two cylinder engine is illustrated in FIGS. 3 and 4 having the rearward cylinders 30 and 32 only.

The engine of FIG. 1 is also shown to include a main crankcase 42, an intermediate crankcase 44 and a crankcase hub 46. Affixed or integral with the main crankcase 42 are engine mounts 48. A propeller shaft 50 is shown extending forwardly of the crankcase hub 46 with a propeller hub 52. The hub 52 and shaft 50 are coupled with a crankshaft located within the engine.

Figure 12:
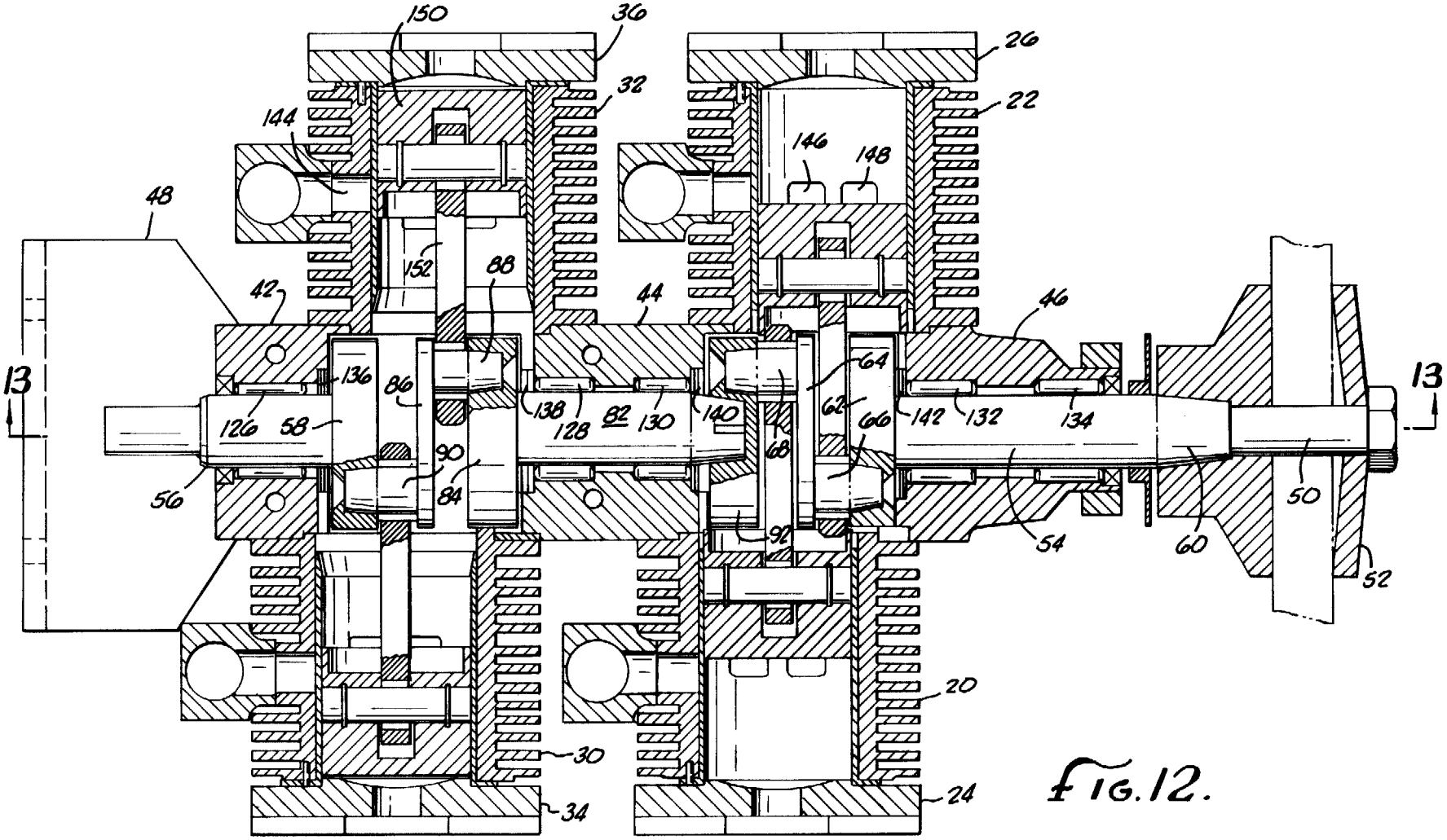
FIG. 12 is a cross-sectional plan view taken along line 12—12 of FIG. 2.
Figure 13:
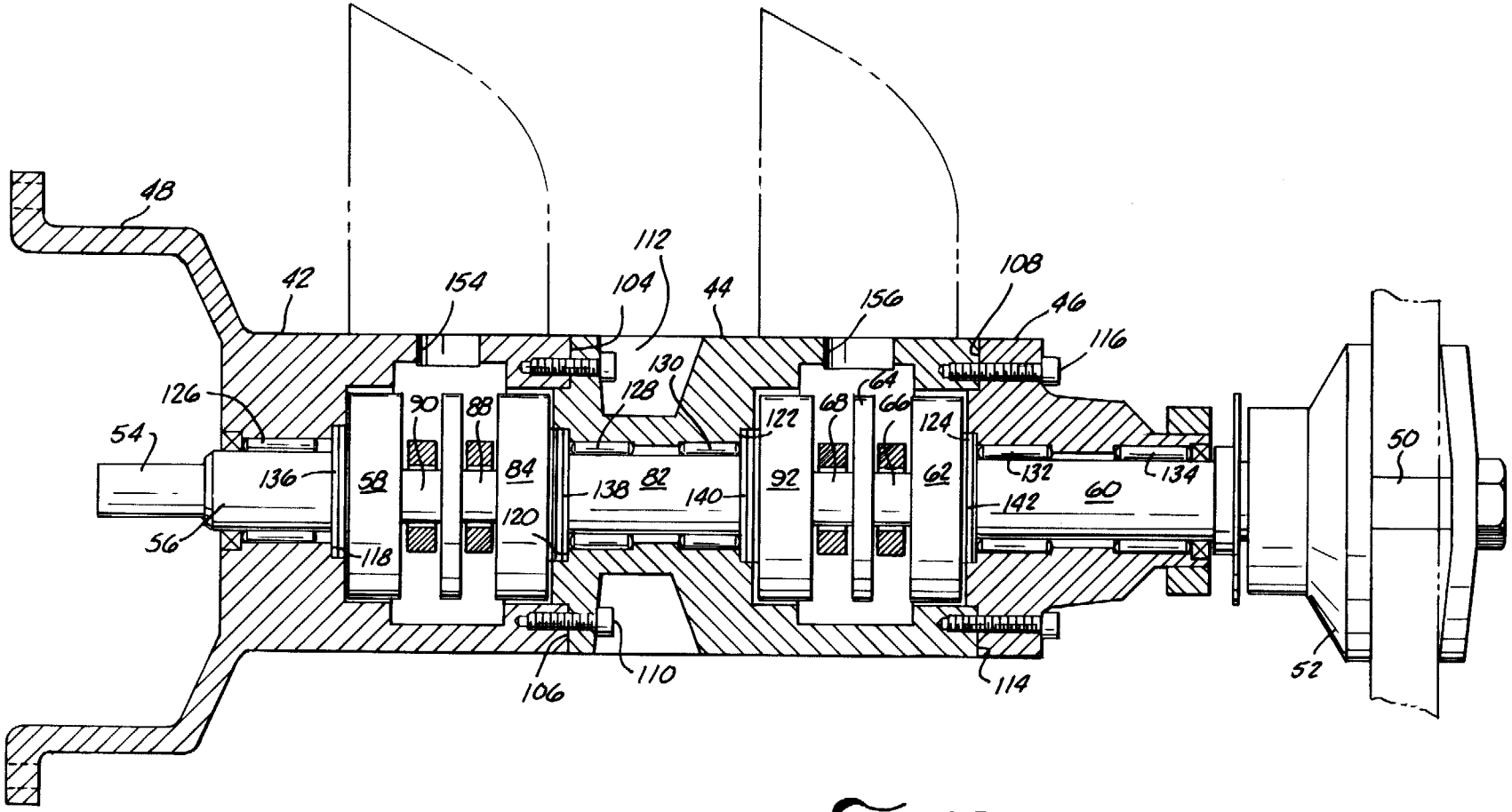
FIG. 13 is a cross-sectional side view taken along line 13—13 of FIG. 12.

Turning to the cross sections of FIGS. 12 and 13, the internal portion of a four cylinder two cycle engine of the present invention is illustrated including a composite crankshaft 54. The crankshaft 54 includes a first bearing shaft 56. At one end of the first bearing shaft 56 is a crank web 58. The bearing shaft 56 forms one end of the crankshaft 54. At the other end of the crankshaft 54 is a second bearing shaft 60 which also includes a crank web 62 at one end thereof. Intermediate the two crankwebs 58 and 62, a plurality of configurations are available in the preferred embodiment. A configuration for a two cylinder engine is illustrated in FIG. 7 while a configuration for a four cylinder engine is illustrated in FIG. 8.

Figure 7:
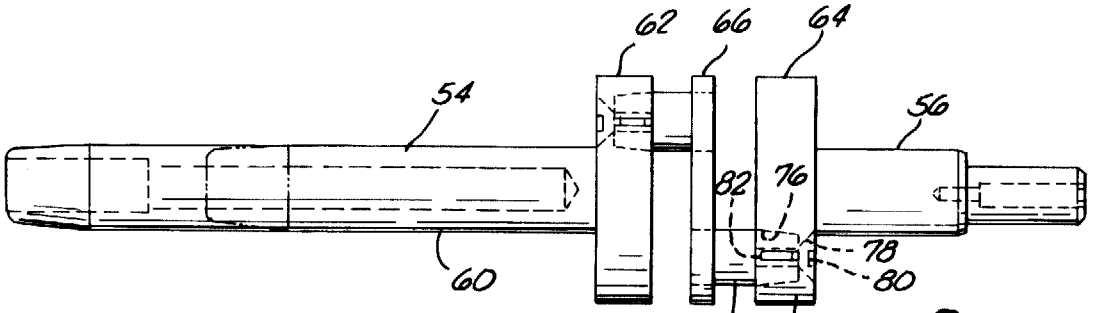
FIG. 7 is a plan view of a crankshaft for a two cylinder engine of the present invention.
Figure 11:
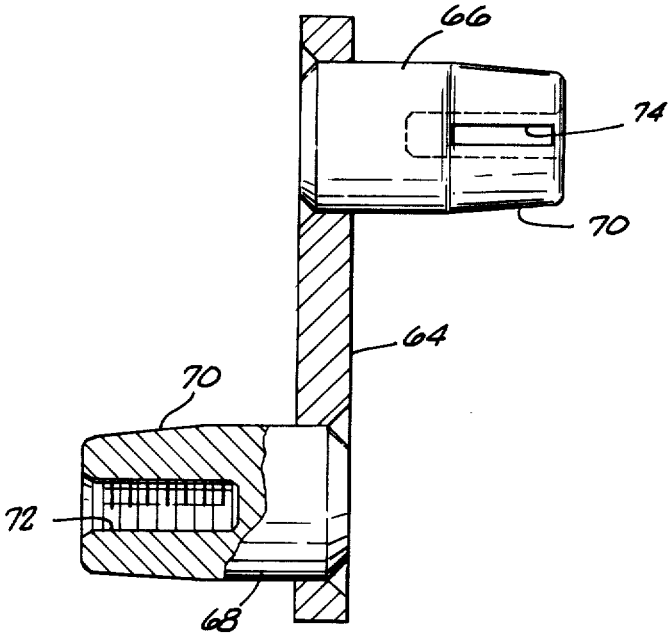
FIG. 11 is a cross-sectional view of an intermediate crank web of the present invention.

In the embodiment of FIG. 7, an intermediate crank web 64 is positioned between the crank webs 58 and 62. The intermediate crank web 64 includes two crank pins 66 and 68 which can be seen in FIG. 7 to be positioned eccentrically on the intermediate crank web 64 and diametrically arranged. The intermediate crank web 64 is best illustrated in FIG. 11. The crank pins 66 and 68 are shown to be welded to the intermediate crank web 64. Each pin 66 and 68 extends to a tapered portion 70 having a threaded hole 72 in the very end thereof. Preferably a locking taper fit is employed, normally five degrees or less. Woodruff key slots 74 are located to either side of the tapered portion 70 of each pin 66 and 68. Each of the crank webs 58 and 62 includes a hole 76 for receipt of one of the crank pins 66 and 68. The hole 76 includes a smaller hole, preferably with a cavity 78 for receipt of a bolt 80 which may be threaded into the hole to draw one of the pins 66 or 68 into compressed engagement with the associated crank web. Woodruff keys 82 prevent the crank pins 66 and 68 from rotating relative to the crank webs 58 and 62.

Figure 8:
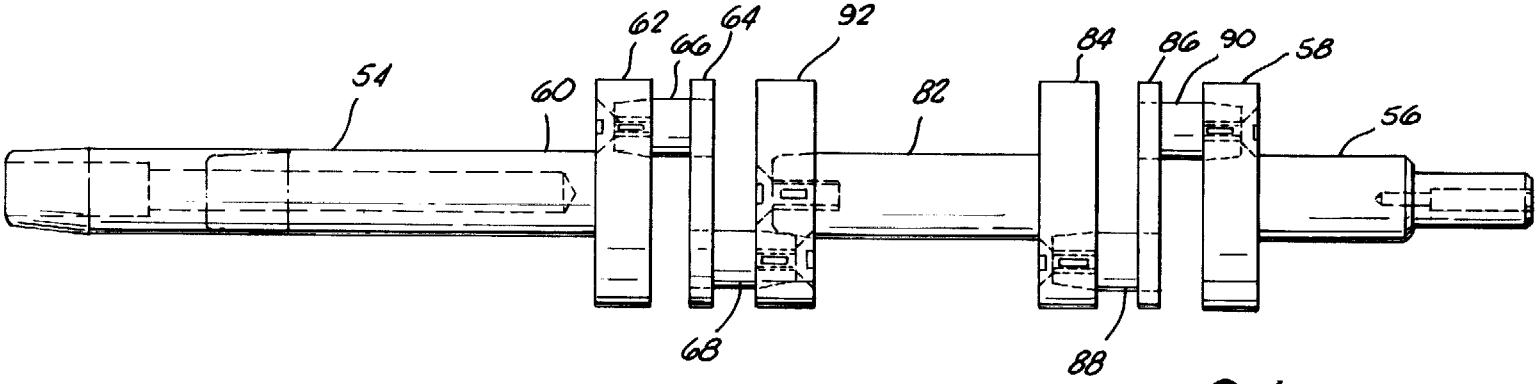
FIG. 8 is a plan view of a crankshaft for a four cylinder engine of the present invention.
Figure 9:
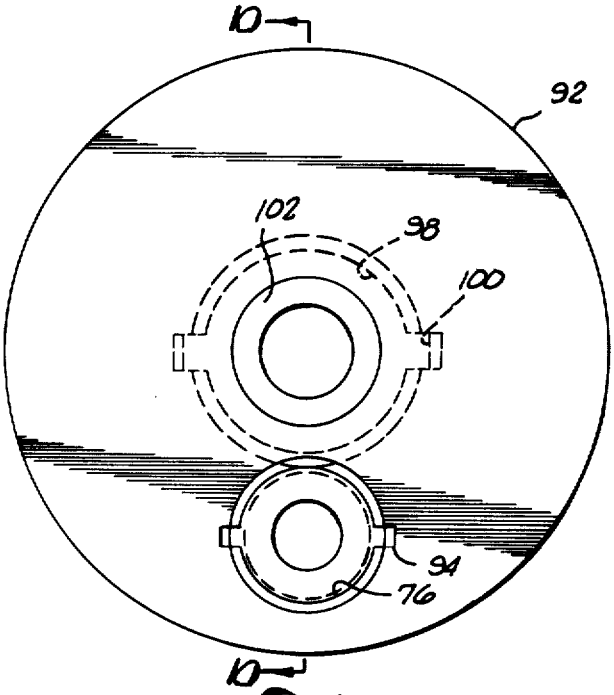
FIG. 9 is a plan view of a crank web.
Figure 10:
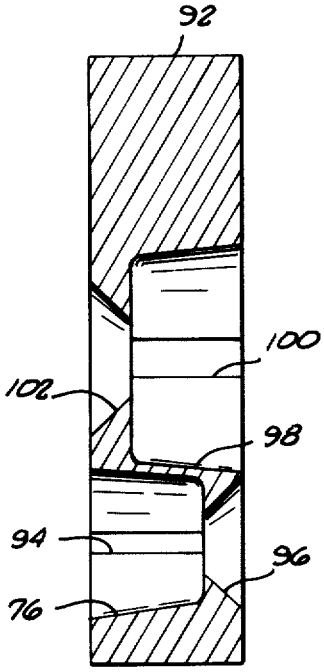
FIG. 10 is a cross-sectional view taken along line 10—10 of FIG. 9.

In FIG. 8, a crankshaft extension is employed to create a crankshaft accommodating four connecting rods. The crankshaft extention includes an intermediate bearing shaft 82 which is tapered at a first end and includes a crank web 84 at its other end. A second intermediate crank web 86 couples the crank webs 84 and 58 and provides two additional crank pins 88 and 90. To couple the intermediate bearing shaft 82 to the original intermediate crank web, a separate crank web 92 is employed. This crank web 92 is best illustrated in FIGS. 9 and 10.

The crank web 92 includes an eccentric hole 76 as do the other crank webs 58, 62 and 84. A Woodruff key slot 94 is provided on either side of the hole and the hole 76 includes a tapered portion 96 to receive a bolt for drawing a crank pin into position. The crank web 92 also includes a concentrically located hole 98 which includes a Woodruff key slot 100 and a conical portion 102 for receipt of a bolt. The hole 98 is sized to accommodate the tapered end of the intermediate bearing shaft 82. To provide the interchangeability of components necessary for expansion of the crankshaft from two crank pins to four crank pins, the holes 76 are preferably the same. It is through the hole 76 that the crankshaft extension is coupled with the crankshaft having the lesser number of crank pins.

The crankcase is assembled in a manner which may be best illustrated by viewing FIG. 13. The main crankcase 42 is provided with a first mounting face 104 capable of mating with a mounting face 106 on the intermediate crankcase 44. The mounting face 104 on the main crankcase 42 is also capable of mating with a mounting surface 108 on the crankcase hub 46. Fasteners 110 couple the main and intermediate crankcases 42 and 44 together across the mounting faces 104 and 106. Cavities 112 provide access to the fasteners 110. The intermediate crankcase 44 includes a mounting face 114 to mate with the mounting face 108 on the crankcase hub 46. Again, fasteners 116 extend across these mounting faces to couple the intermediate crankcase 44 and the crankcase hub 46 together.

The main crankcase 42 also has an internal thrust shoulder 118 which faces in the same direction as the mounting surface 104. Rather than have the main crankcase portion 42 support both ends of the shaft, a thrust shoulder 120 on the face 106 of the intermediate crankcase 44 opposes the internal thrust should 118 to define constraining thrust shoulders to either side of the crank pins 88 and 90. Similarly, an internal thrust shoulder 122 and and external thrust shoulder 124 are defined on the intermediate crankcase 44 and the crankcase hub 46, respectively. The thrust shoulder 124 may be employed on a two cylinder engine by replacing the thrust shoulder 120 following removal of the intermediate crankcase 44.

To support the shaft 54 in the crankcase, roller bearings 126, 128, 130, 132 and 134 are employed. Thrust bearings 136, 138, 140 and 142 surround each couple of crank pins. Thus, substantial bearing support is provided to the composite crankshaft 54.

Looking again to FIG. 12, the cylinders 20, 22, 30 and 32 are shown to be located on the crankcase sections. Long studs, not shown, are used to bolt the cylinders to the crankcase. The cylinders illustrated are two stroke cylinders having exhaust ports 144 and transfer ports 146 and 148 controlled by pistons 150. The pistons 150 are coupled by means of a connecting rod 152 to the various crank pins 66, 68, 88 and 90 on the composite crankshaft 54. Intakes 154 and 156 are provided through the main crankcase 42 and intermediate crankcase 44 into the interior thereof, respectively.

Thus, a composite engine is disclosed which may have two, four or more cylinders associated with a composite crankcase which expands to meet the number of cylinders required and a composite crankshaft which does the same. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A crankshaft for a composite engine, comprising a first bearing shaft having a first main crank web at one end thereof;

a second bearing shaft having a second main crank web at one end thereof;

first and second intermediate crank webs each having first and second substantially identical crank pins positioned eccentrically and diametrically opposed therein and said first and second main crank webs including holes therein to receive respectively said first crank pins from said first and second intermediate crank webs; and a third main crank web and an intermediate bearing shaft having a fourth main crank web at one end thereof, said third main crank web having a concentric hole therein to receive a second end opposite said one end of said intermediate bearing shaft and said third and fourth main crank webs including holes for receipt of said second crank pins.

2. The crankshaft of claim 1 wherein said concentric hole and said second end of said intermediate bearing shaft include a keyway and key to prevent relative rotation therebetween.

3. The crankshaft of claim 1 wherein said holes are tapered and said crank pins are tapered for a locking taper fit in said holes, each of said first, second, third and fourth main crank webs including bolts extending into said holes to draw respective crank pins therein.

4. A composite engine comprising a first bearing shaft having a first main crank web at one end thereof;

a second bearing shaft having a second main crank web at one end thereof;

first and second intermediate crank webs each having a first and second crank pins positioned eccentrically and diametrically opposed therein and said first and second main crank webs including holes therein to receive respectively said first crank pins from said first and second intermediate crank webs;

a third main crank web and an intermediate bearing shaft having a fourth main crank web at one end thereof, said third main crank web having a concentric hole therein to receive a second end opposite said one end of said intermediate bearing shaft and said third and fourth main crank webs including holes for receipt of said second crank pins; and a crankcase receiving said crankshaft and including a main crankcase having a first mounting face at one end thereof adjacent said third main crank web normal to a central crankshaft axis, an intermediate crankcase having a second mounting face at one end thereof capable of mating with said first face and a third mounting face at a second end thereof adjacent said first main crank web, said second and third mounting faces being normal to said crankshaft and a crankcase hub having a fourth mounting face capable of mating with said first mounting face and with said third mounting face.

5. The composite engine of claim 4 wherein said second and fourth mounting faces have thrust shoulders normal to said crankshaft axis and said main crankcase and said intermediate crankcase each has an internal thrust shoulder, said internal thrust shoulder of said main crankcase is displaced from and facing in the same axial direction as said first mounting face and said internal thrust shoulder of said intermediate crankcase is displaced from and facing in the same direction as said third mounting face.

6. The composite engine of claim 4 wherein said main crankcase includes engine mounts.

7. The composite engine of claim 4 further comprising four cylinders, two of said cylinders being mounted to said main crankcase and two of said cylinders being mounted to said intermediate crankcase.

8. The composite engine of claim 7 wherein said cylinders are two-stroke engine cylinders.

9. The composite engine of claim 8 wherein said main crankcase and said intermediate crankcase each include an intake port through the sidewall thereof.

10. A composite engine comprising a crankshaft; and a crankcase rotatably supporting said crankshaft and including a main crankcase having a first mounting face at one end thereof normal to said crankshaft, an intermediate crankcase having a second mounting face thereof capable of mating with said first face and a third mounting face at a second end thereof, said second and third mounting faces being normal to a central crankshaft axis and a crankcase hub having a fourth mounting face capable of mating with said first mounting face and with said third mounting face, said second and fourth mounting faces having thrust shoulders normal to said crankshaft axis and said main crankcase and said intermediate crankcase each having an internal thrust shoulder, said internal thrust shoulder of said main crankcase being displaced from and facing in the same axial direction as said first mounting face and said internal thrust shoulder of said intermediate crankcase being displaced from and facing in the same direction as said third mounting face.

11. A composite engine comprising a first bearing shaft having a first main crank web at one end thereof;

a second bearing shaft having a second main crank web at one thereof;

first and second intermediate crank webs each having first and second crank pins positioned eccentrically and diametrically opposed thereon, with said first and second main crank webs including holes therein to receive respectively said first crank pins from said first and second intermediate crank webs;

a third main crank web and an intermediate bearing shaft having a fourth main crank web at one end thereof, said third main crank web having a concentric hole therein to receive a second end opposite said one end of said intermediate bearing shaft and said third and fourth main crank webs including holes for receipt of said second crank pins; and a crankcase rotatably supporting said crankshaft and including a main crankcase having a first mounting face at one end thereof normal to said crankshaft, an intermediate crankcase having a second mounting face capable of mating with said first face and a third mounting face at a second end thereof, said second and third mounting faces being normal to a central crankshaft axis and a crankcase hub having a fourth mounting face capable of mating with said first mounting face and with said third mounting face, said second and fourth mounting faces having thrust shoulders normal to said crankshaft axis and said main crankcase and said intermediate crankcase each having an internal thrust shoulder, said internal thrust shoulder of said main crankcase being displaced from and facing in the same axial direction as said first mounting face and said internal thurst shoulder of said intermediate crankcase being displaced from and facing in the same direction as said third mounting face, said first first intermediate crank web disposed inbetween said thrust shoulders of said first and second mounting faces and said second intermediate crank web disposed inbetween said thrust shoulders of said third and fourth mounting faces, such that said crank pins on said first and second intermediate crank webs are axially constrained in place.

* * * * *

UNITED STATES PATENT AND TRADEMARK OFFICE

CERTIFICATE OF CORRECTION

PATENT NO. : 4,714,060

DATED : December 22, 1987

INVENTOR(S) : RAYMOND P. KESTELOOT

It is certified that error appears in the above—identified patent and that said Letters Patent is hereby corrected as shown below:

In column 4, line 57, delete "a".

In column 6, line 9, after "one" insert -- end --.

Signed and Sealed this

Seventh Day of June, 1988

*Attest:*

*Attesting Officer*

DONALD J. QUIGG

*Commissioner of Patents and Trademarks*